US008602210B2

(12) United States Patent
Milner et al.

(10) Patent No.: US 8,602,210 B2
(45) Date of Patent: Dec. 10, 2013

(54) CIGAR HOLDER DEVICE

(75) Inventors: Mark S. Milner, White Lake, MI (US); Julien P. Thiebaud, San Diego, CA (US)

(73) Assignee: Marco Design, LLC, White Lake, MI (US)

( * ) Notice: Subject to any disclaimer, the term of this patent is extended or adjusted under 35 U.S.C. 154(b) by 131 days.

(21) Appl. No.: 13/195,085

(22) Filed: Aug. 1, 2011

(65) Prior Publication Data

US 2012/0031780 A1 Feb. 9, 2012

Related U.S. Application Data

(60) Provisional application No. 61/370,268, filed on Aug. 3, 2010.

(51) Int. Cl.
*B65D 85/12* (2006.01)

(52) U.S. Cl.
USPC ..... 206/261; 206/242; 131/250

(58) Field of Classification Search
USPC ..... 206/265, 267, 268, 261, 262, 263, 242, 206/204, 236; 215/6, 386; 131/250, 303, 131/329
See application file for complete search history.

(56) References Cited

U.S. PATENT DOCUMENTS

| | | | | |
|---|---|---|---|---|
| 175,171 | A | 3/1876 | Rumpp | |
| 1,130,739 | A | 3/1915 | Kaufmann | |
| D147,120 | S | 7/1947 | Dietrich | |
| 2,559,000 | A * | 7/1951 | Back | 312/31 |
| 4,465,184 | A | 8/1984 | Bruce | |
| 5,881,868 | A * | 3/1999 | Soyak et al. | 206/213.1 |
| D408,942 | S | 4/1999 | Fanning et al. | |
| 5,957,277 | A * | 9/1999 | Elliott | 206/205 |
| D426,018 | S | 5/2000 | White et al. | |
| 6,244,434 | B1 * | 6/2001 | Brooks | 206/236 |
| 6,298,857 | B1 | 10/2001 | Schmidt | |
| D573,303 | S | 7/2008 | Fuente | |
| 7,416,078 | B2 * | 8/2008 | Willis | 206/236 |
| D596,788 | S | 7/2009 | Fuente | |
| 7,717,259 | B2 * | 5/2010 | Hatton | 206/236 |
| 2009/0217934 | A1 * | 9/2009 | Soyak et al. | 131/303 |

* cited by examiner

*Primary Examiner* — David Fidei
(74) *Attorney, Agent, or Firm* — Harness, Dickey & Pierce, P.L.C.

(57) ABSTRACT

A portable cigar case includes a body having at least one cavity for receiving and releasably retaining a cigar. A cap is releasably connected to the body. The cap when in an open condition provides access to the cigar. A moisture retainer is provided in one of the body or the cap. The moisture retainer provides a source of moisture to maintain a humidity level of the cigar when the cap is in a closed condition with respect to the body. A vial containing a drinkable fluid is retained by one of the body or the cap. The vial is made of a transparent or semitransparent material such that the fluid in the vial is visible to a user. A viewing window created in the cigar case is aligned with the vial such that the fluid in the vial is visible through the viewing window.

6 Claims, 9 Drawing Sheets

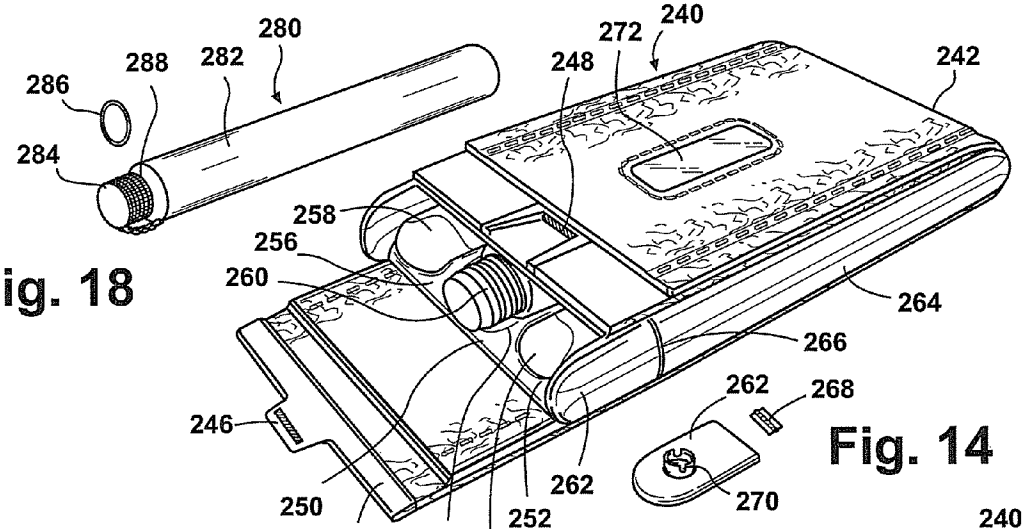
Fig. 18
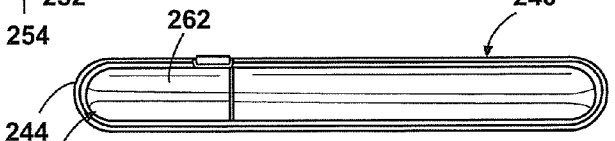
Fig. 14
Fig. 15
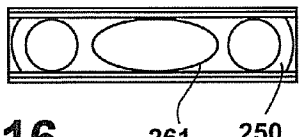
Fig. 16
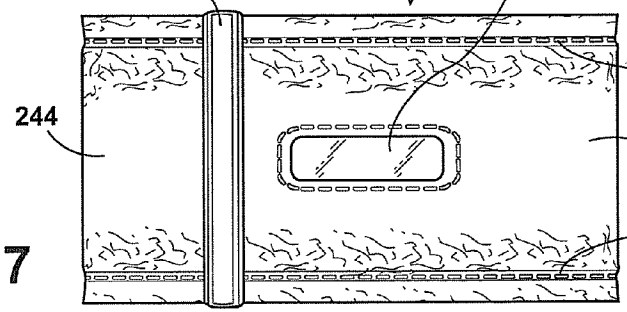
Fig. 17

CIGAR HOLDER DEVICE

CROSS-REFERENCE TO RELATED APPLICATIONS

This application claims the benefit of U.S. Provisional Application No. 61/370,268, filed on Aug. 3, 2010. The entire disclosure of the above application is incorporated herein by reference.

FIELD

The present disclosure relates to hand held portable cigar humidors and holders.

BACKGROUND

This section provides background information related to the present disclosure which is not necessarily prior art.

Portable hand held cigar holders often include a moisture source for maintaining a humidity level of the cigars being carried. Cigar holders also include individual tubes or sleeves for securely holding individual cigars are also known.

Known cigar holders, however, may not substantially enclose the individual cigars with a material intended to enhance moisture retention. Known cigar holders do not provide a fluid vial in addition to a humidification moisture source. Known cigar holders further do not provide the user with a volume of drinking fluid which is co-carried with the cigars in a medium which is accessible and refillable and further having a fluid level viewing window to visually determine the volume of fluid.

SUMMARY

This section provides a general summary of the disclosure, and is not a comprehensive disclosure of its full scope or all of its features.

According to several embodiments, a portable cigar case includes a body having at least one cavity for receiving and releasably retaining a cigar. A cap is releasably connected to the body. The cap when in an open condition provides access to the cigar. A moisture retainer is provided in one of the body or the cap. The moisture retainer provides a source of moisture to maintain a humidity level of the cigar when the cap is in a closed condition with respect to the body. A vial containing a drinkable fluid is retained by one of the body or the cap. The vial is made of a transparent or semitransparent material such that the fluid in the vial is visible to a user. A viewing window created in the cigar case is aligned with the vial such that the fluid in the vial is visible through the viewing window.

According to other embodiments, the cigar case includes a leather cover over at least a portion of the cigar case to provide a grip surface. According to further embodiments, the cigar case includes at least one retention portion that is rotatably connected by a hinge to the body. A retention member is used to connect the retention portion to the body so the retention portion can be moved to a position for removal of a cigar. A combination of an engagement element on the retention member in contact with an engagement feature on the body can be used to position the retention member in a closed condition with respect to the body. A vial end cap can be releasably connected to the vial to permit opening and closing the vial to remove or add the drinking fluid to the vial. An end cap releasably connected to the body can be moved to an open condition to permit access to the vial end cap. The vial can also be made of a non-transparent material such as metal to increase a rigidity of the vial body for further protection of the cigars carried in the cigar case.

According to further embodiments, the retention member can include a liner of a wood material selected for a humidity retaining capability. Wood selected for this purpose can include cedar. The geometry of the liner matches the geometry of the retention member, and the liner and retention member together define a slot sized to slidably and releasably retain an individual cigar in contact with the liner. In further embodiments, the body includes semicircular or circular shaped cigar receiving cavities that individually receive a cigar. A cigar positioned in any cavity is exposed to moisture in the moisture retainer.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 14 is a top perspective view of another cigar holder device of the present disclosure having a folding end cover in an open configuration;

FIG. 15 is a side elevational view of the cigar holder of FIG. 14 shown in a fully closed configuration;

FIG. 16 is an end elevational view of the cigar holder of FIG. 14;

FIG. 17 is a top plan view of the cigar holder of FIG. 14; and

FIG. 18 is a perspective view of another embodiment of a fluid vial for use in the cigar holder of FIG. 14.

Corresponding reference numerals indicate corresponding parts throughout the several views of the drawings.

DETAILED DESCRIPTION

Figure 1:
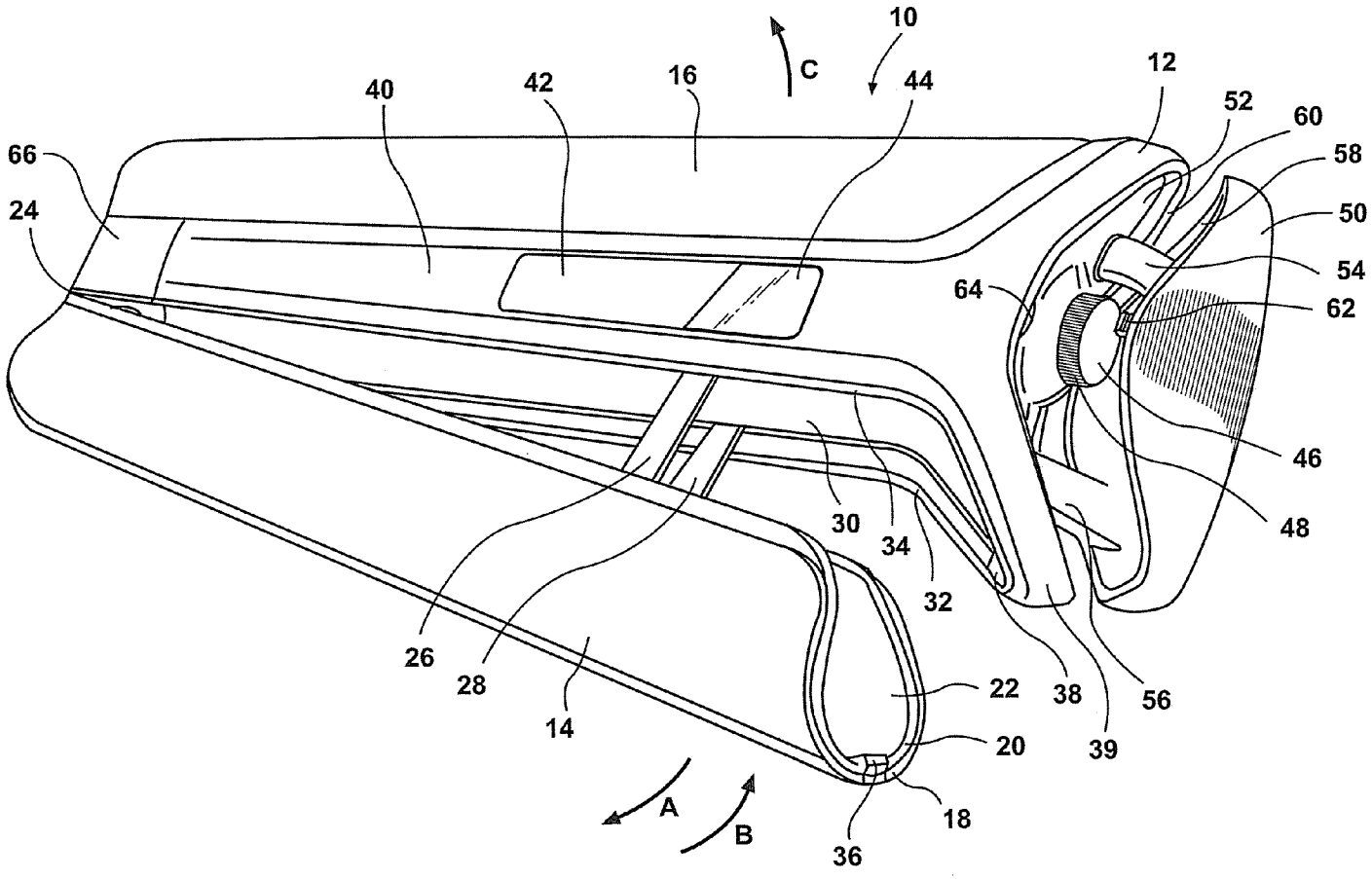
FIG. 1 is a front perspective view of a cigar holder device of the present disclosure in a partially open configuration.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a cigar case 10 includes a body 12 having each of a first and a second retention portion 14, 16 oppositely rotatably extendable from body 12. First retention portion 14 is shown in its rotated and extended position while second retention portion 16 is shown in its closed position. Each of the first and second retention portions 14, 16 includes the following common elements; therefore, the following discussion of first retention portion 14 applies equally to second retention portion 16. An outer sleeve 18 is formed in a generally U or horseshoe shape and a sleeve liner 20 is co-aligned on an inner surface of outer sleeve 18. Sleeve liner 20 according to several embodiments is a wood material, such as cedar used for its aromatic and moisture retention capability.

A cigar receiving slot 22 is defined within sleeve liner 20 sized to slidably receive a single cigar (not shown). First retention portion 14 is rotatably connected to body 12 using a hinge 24. When rotated in a first opening direction "A" with respect to hinge 24, first retention portion 14 is retained at a maximum open position shown using first and second retention members 26, 28, individually fixedly connected to each of the first retention portion 14 and body 12. First and second retention members 26, 28 can be made of a flexible material such as woven belt material, flexible polymeric material, or they can be a substantially rigid material slidably received within body 12 and retained therein. When first retention portion 14 is in the closed position, a receiving cavity 30 created between first and second opposed cavity outer walls 32, 34 aligns substantially in parallel with cigar receiving slot 22.

In order to releasably latch first retention portion 14 to body 12, an engagement element 36 is provided at a free end of first retention portion 14, which releasably engages an engagement feature 38 provided with a curved body portion 39 of body 12. When first retention portion 14 is moved in a closing direction "B," cigar receiving slot 22 is substantially aligned with a similarly shaped cavity defined by curved body portion 39.

Body 12 further includes a vial portion 40, which is sealed with respect to each of the first and second retention portions 14, 16 to permit retention of a potable, drinking or drinkable fluid 42 selected at the discretion of the user. A level or volume of fluid 42 within vial portion 40 is visible through a viewing window 44 positioned on body 12 and made, for example, of a transparent or semitransparent material such as plastic or glass. Fluid 42 is replenishable or discharged from vial portion 40 by temporarily removing a vial end cap 46 using a grip surface 48 to threadably rotate vial end cap 46. Vial end cap 46 is accessible by temporarily displacing a body end cap 50 from a body end 52 of body 12. Body end cap 50 is retained at body end 52 using each of a first and second retention element 54, 56. First and second retention elements 54, 56 can be made from a same or similar material as that used for first and second retention members 26, 28. When body end cap 50 is releasably retained in a closed position on body end 52, a cap perimeter wall 58 abuts against a body end wall 60 and a deflectable member 62 of body end cap 50 is releasably engaged with an engagement member 64 of body 12.

Cigar case 10 further includes a humidifier portion 66, which is releasably connected at an opposite end of body 12 with respect to body end cap 50. Humidifier portion 66 contains water, which can vaporize and enter both of the first and second retention portions 14, 16 to maintain humidity levels for the cigars stored therein.

Figure 2:
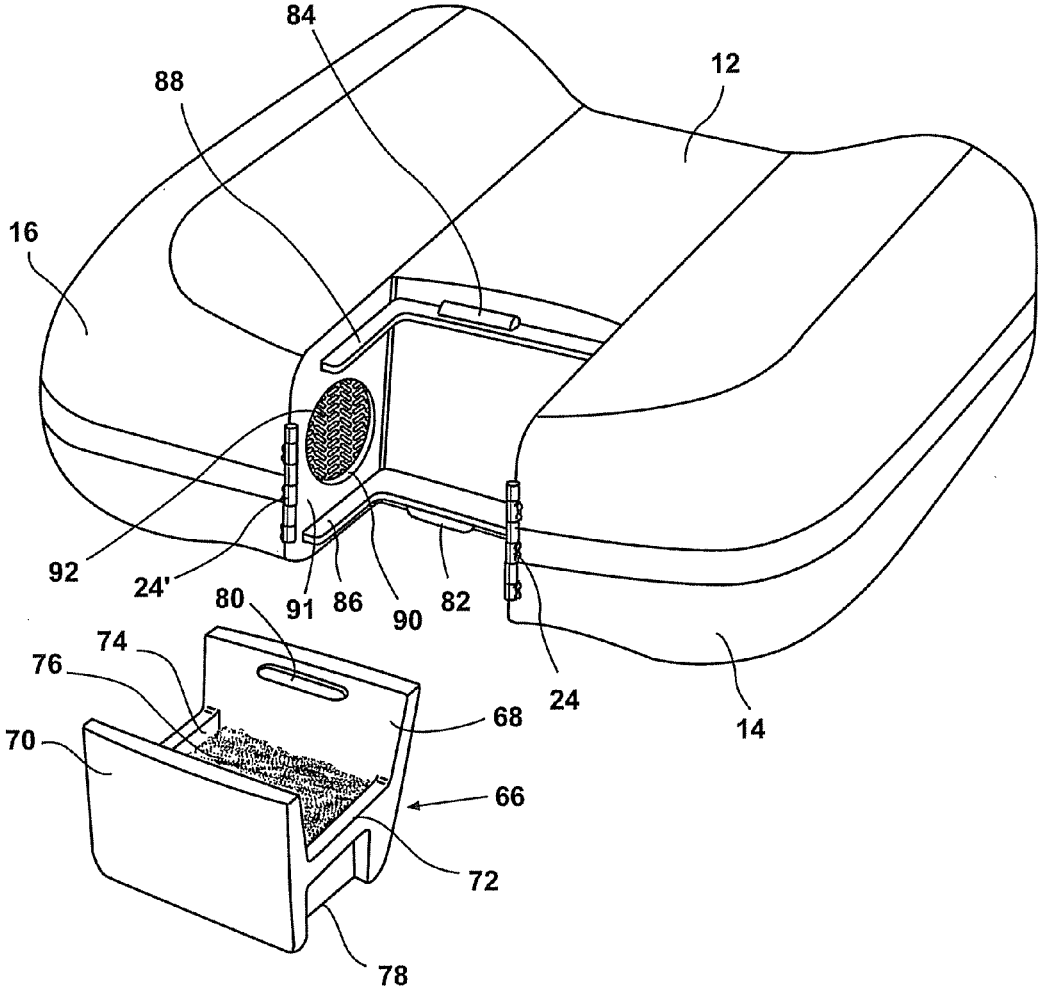
FIG. 2 is an end perspective view of the cigar holder device of FIG. 1.

Referring to FIG. 2, humidifier portion 66 is shown after release from body 12. Humidifier portion 66 includes each of a first outer wall 68 and an opposed second outer wall 70. First and second outer walls 68, 70 are joined by opposed first and second joining walls 72, 74. A moisture retainer 76, such as moisture retention crystals or a foam material, is retained between first and second joining walls 72, 74. It is noted that humidifier portion 66 is shown rotated approximately 90 degrees from its installed position to more clearly identify the features discussed herein. A recessed portion 78 is provided in first joining wall 72 to provide clearance in the installed position with respect to hinge 24. A similar recessed portion (not visible in this view) is provided for the similar purpose of providing clearance with respect to hinge 24'. An engagement slot 80 is provided on an inside facing surface of first outer wall 68. Engagement slot 80 is sized to releasably receive a first male member 82 extending from body 12 to releasably retain humidifier portion 66 in its closed contact position with body 12.

Similar to engagement slot 80, a second engagement slot (not clearly visible in this view) is provided on an inside facing surface of second outer wall 70 and is adapted to receive a second male member 84, which is provided for a similar purpose as first male member 82. First and second outer walls 68, 70 are each outwardly elastically deflectable to permit engagement with first and second male members 82, 84. First and second male members 82, 84 are each integrally connected to and extend outwardly with respect to first and second support features 86, 88. First and second support features 86, 88 also retain the alignment of humidifier portion 66 when it is releasably in contact with body 12.

A moisture exchange opening 90 is positioned in a wall 91 of body 12 such that the moisture contained by moisture retainer 76 can vaporize and enter second retention portion 16 through a filter 92 provided to prevent material of moisture retainer 76 from also entering second retention portion 16. Oppositely directed with respect to moisture exchange opening 90 and filter 92 are a similar moisture exchange opening and filter (not visible in this view) which perform the same function with respect to first retention portion 14.

Figure 3:
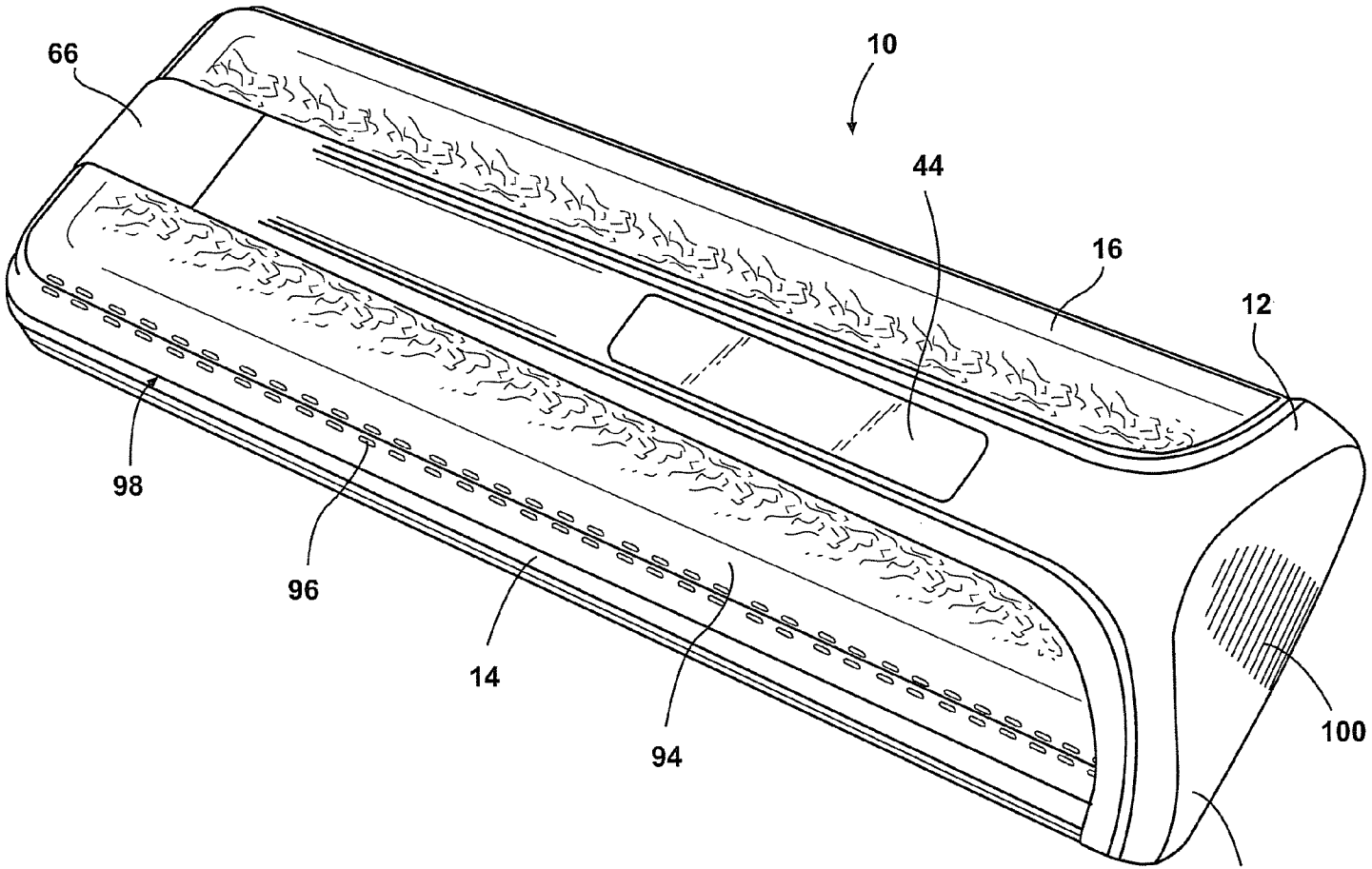
FIG. 3 is the front perspective view of the cigar holder device of FIG. 1 in a fully closed configuration.

Referring to FIG. 3, both first and second retention portions 14, 16 are shown in their closed and retained positions with respect to body 12. Humidifier portion 66 is also shown in its closed and retained position. Body end cap 50 is similarly shown in its closed position. A covering 94, such as leather or a polymeric material which visually has the appearance of leather, can be applied to outer surfaces of both first and second retention portions 14, 16. For further visual enhancement, stitch seams 96 can be provided with covering 94. Covering 94 is therefore provided with a gripping surface 98, which is provided based on the pliable nature of covering 94 so that the user can grip either first or second retention portion 14, 16 to release them from their closed positions. A plurality of ribs 100 are provided with body end cap 50 to assist in releasing body end cap 50 from the closed position.

Figure 4:
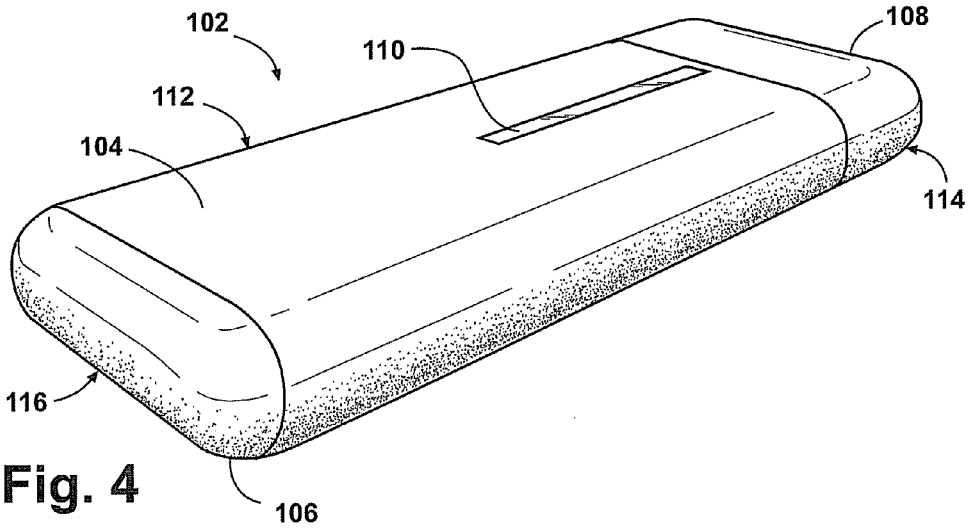
FIG. 4 is a top perspective view of another cigar holder device of the present disclosure in a fully closed configuration.

Referring to FIG. 4, a cigar case 102 of another embodiment includes a polymeric body 104 having a polymeric front cap 106 and a polymeric rear cap 108 connected at opposite ends thereof. A viewing window 110 is provided in polymeric body 104 used to view a fluid level of a built-in, non-removable potable fluid vial. A planar outer surface 112 includes the viewing window 110 and together with the remaining outer surfaces of cigar case 102 provide a substantially smooth surface for ease of inserting the cigar case 102, for example, into or out of a pocket or carry container of the user.

Figure 5:
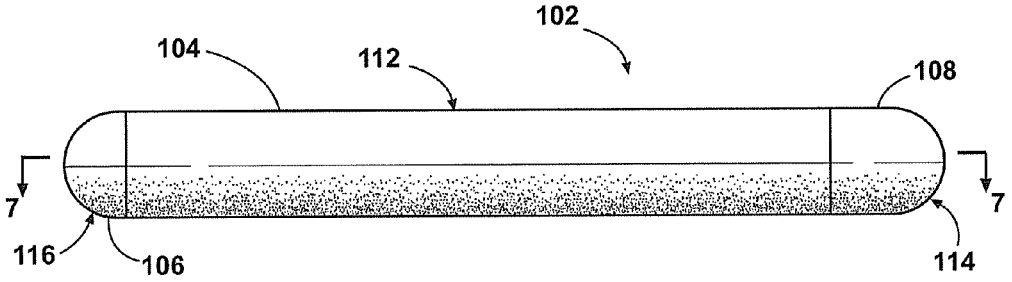
FIG. 5 is a front elevational view of the cigar holder device of FIG. 4.

Referring to FIG. 5, cigar case 102 is provided with a first curved end surface 114 for rear cap 108 and a second curved end surface 116 for front cap 106. First and second curved end surfaces 114, 116 further enhance the capability to easily slide cigar case 102 into or out of the pocket or carry container of the user.

Figure 6:
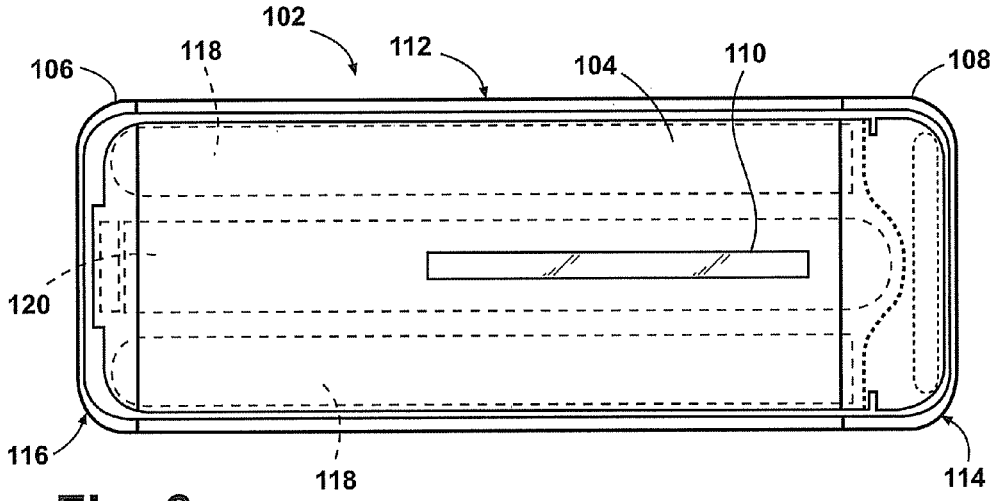
FIG. 6 is a top plan view of the cigar holder device of FIG. 4.

Referring to FIG. 6, cigar case 102 permits two cigars 118 to be stored within polymeric body 104. Each of the cigars 118 is individually positioned on an outer facing portion of a vial 120 which contains a potable/drinkable fluid.

Figure 7:
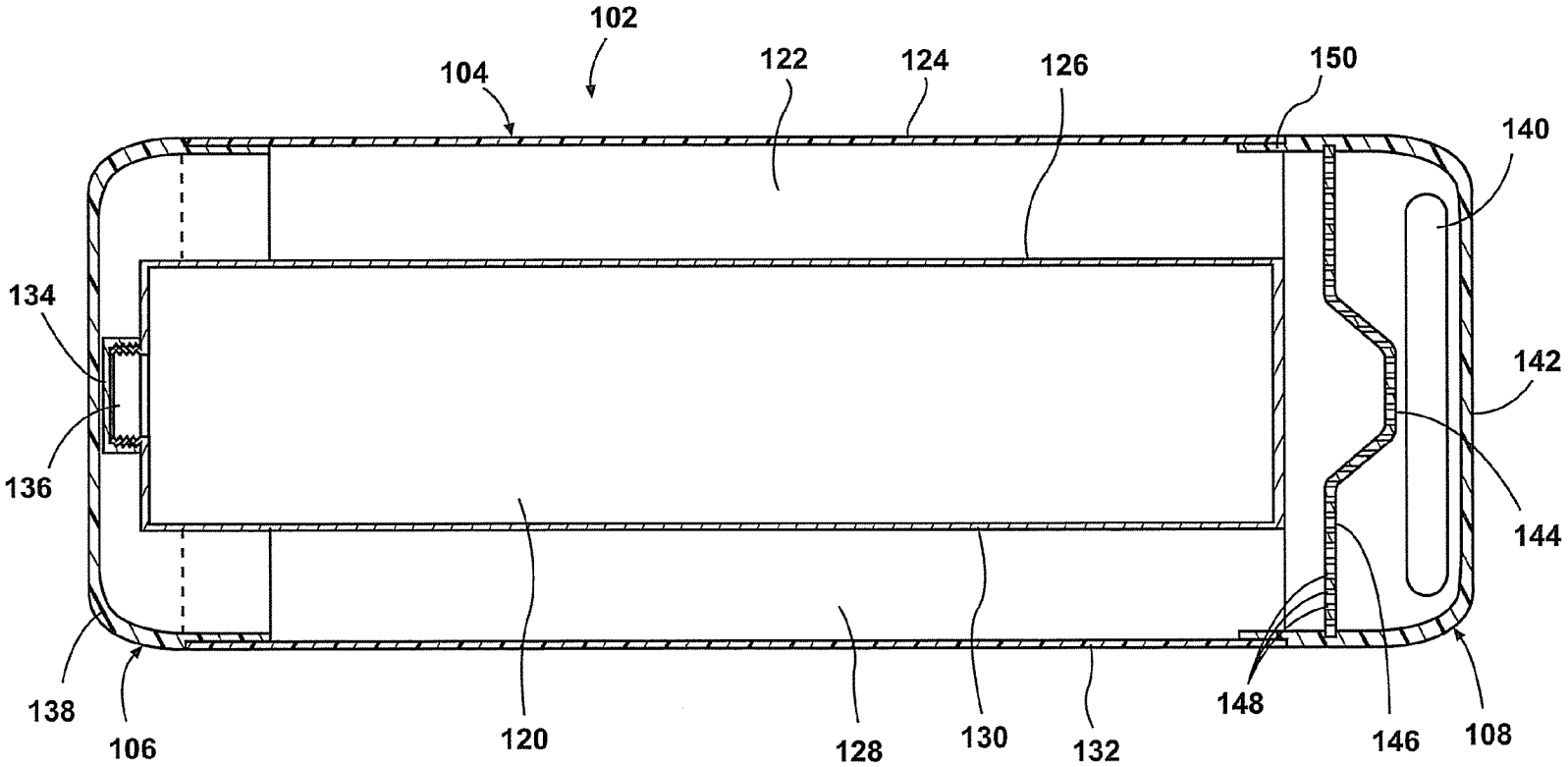
FIG. 7 is cross sectional top plan view taken at section 7 of FIG. 5.

Referring to FIG. 7, cigar case 102 further includes a first cigar cavity 122 created between a first outer wall portion 124 of polymeric body 104 and a first vial outer wall 126 of vial 120. Similarly, but oppositely positioned, is a second cigar cavity 128 provided between a second vial outer wall 130 and a second outer wall portion 132 of polymeric body 104. A vial end cap 134, which is removable and re-engaged by the user, is releasably connected, for example using threads to a vial end extension 136 longitudinally extending from one end of the vial 120. Vial end cap 134 is accessible by removing front cap 106 from polymeric body 104. Front cap 106 is releasably engaged with polymeric body 104 using an engagement wall 138 which frictionally is received within and abuts against an inner wall of polymeric body 104.

A moisture retainer 140, which can be a sponge-like material or moisture retention crystals is positioned within rear cap 108. Moisture retainer 140 is accessible for refilling the moisture stored by moisture retainer 140 by removing rear cap 108 from polymeric body 104. Moisture retainer 140 is positioned between a cap end wall 142 and a longitudinal extending portion 144 of a perforated wall 146. Perforated wall 146 provides a plurality of openings 148 through which the moisture contained by moisture retainer 140 can enter each of the first and second cigar cavities 122, 128. A size of the openings 148 is selected to prevent material of the moisture retainer 140 from entering either of the first or second cigar cavities 122, 128. Rear cap 108 is frictionally engaged with polymeric body 104 in a similar manner as previously described with respect to front cap 106. Rear cap 108 is provided with an engagement wall 150 which frictionally engages an inner wall of polymeric body 104 to releasably retain rear cap 108 on polymeric body 104.

Figure 8:
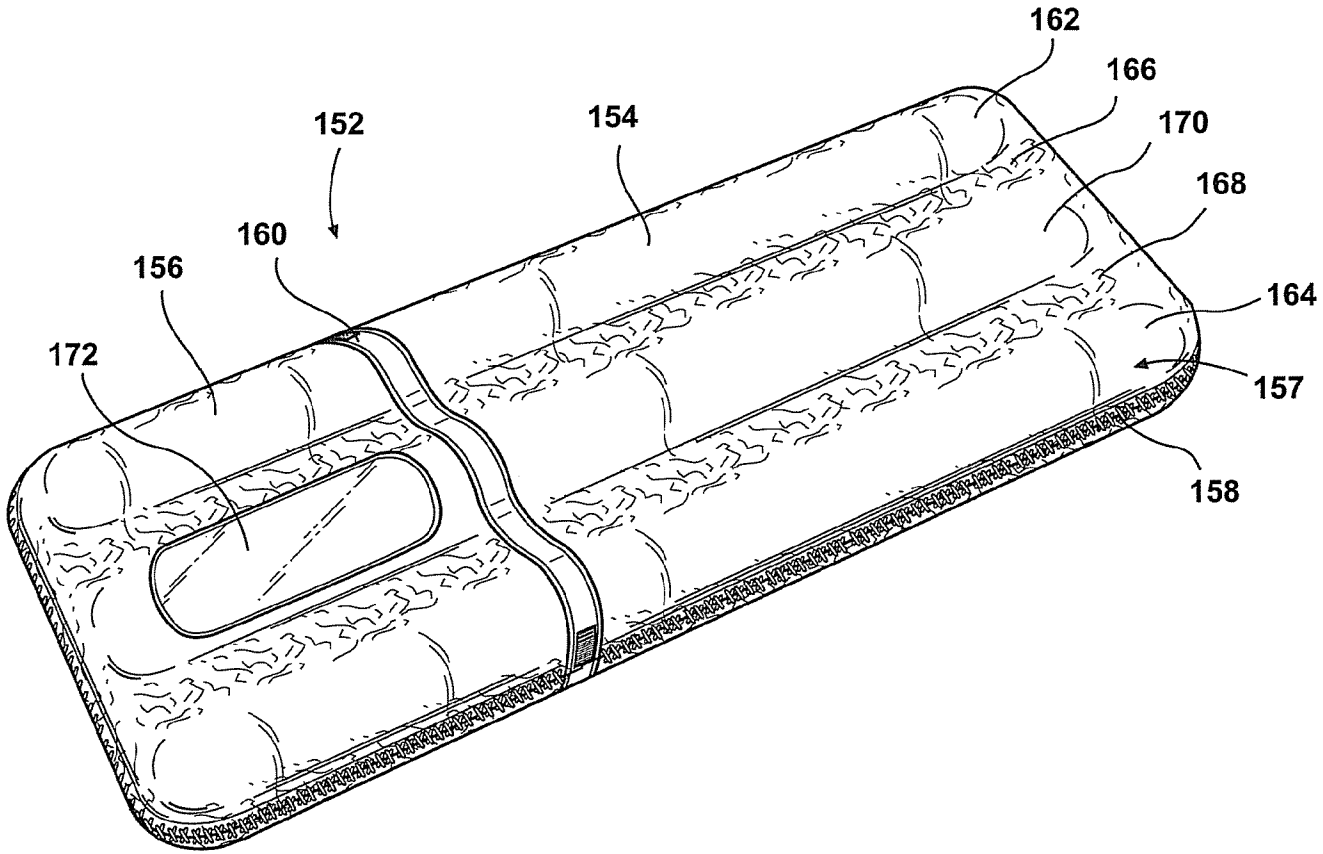
FIG. 8 is a top perspective view of another cigar holder device of the present disclosure in a fully closed configuration.

Referring to FIG. 8, a cigar case 152 according to a further embodiment includes a body 154 and a releasably engaged end cap 156. Body 154 has a covering, such as a leather cover 157, which can be attached using a cross-stitched seam 158. A reflective material strip 160 is provided to visually indicate the dividion between body 154 and end cap 156 when end cap 156 is releasably installed on body 154.

Body 154 further includes each of a first and second raised portion 162, 164 which define individual positions within body 154 for releasably storing individual cigars (not shown). A first indented portion 166 and a second indented portion 168 separate each of the first and second raised portions 162, 164 from a third raised portion 170. Third raised portion 170 provides internal space within body 154 for a fluid vial. Liquid within the fluid vial is visually indicated through a vial viewing window 172 which is coaxially aligned with third raised portion 170 and provided in end cap 156. Similar to vial viewing windows of previous embodiments, vial viewing window 172 can be provided of a transparent or semitransparent material such as a polymeric material or glass.

Figure 9:
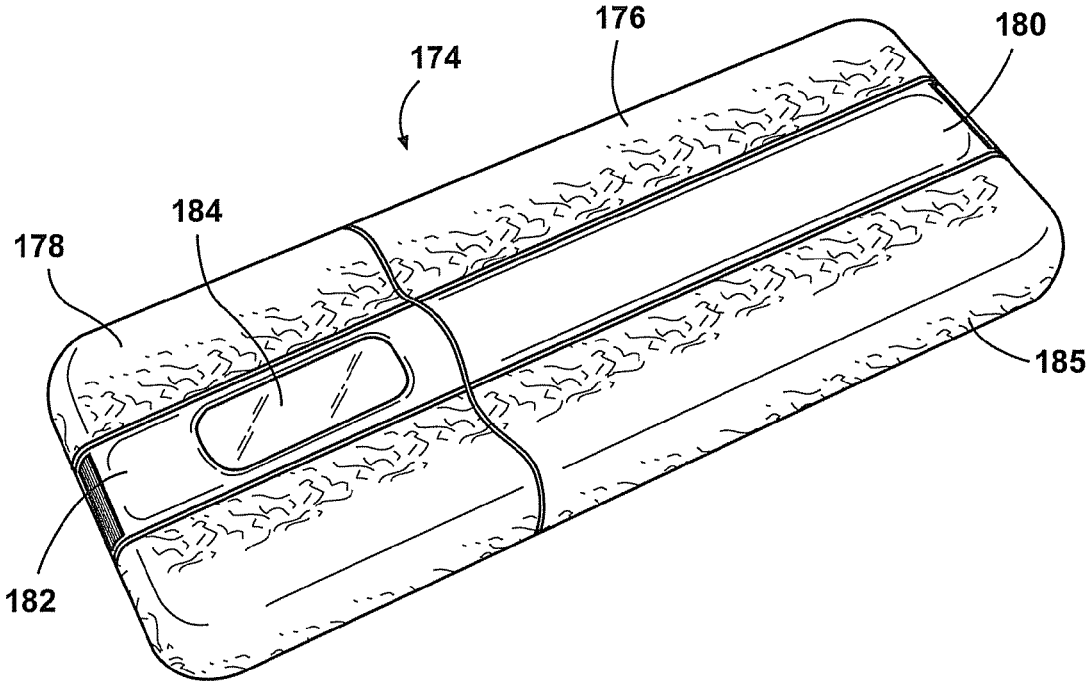
FIG. 9 is a top perspective view of another cigar holder device of the present disclosure in a fully closed configuration.

Referring to FIG. 9 and again to FIG. 8, a cigar case 174 includes a body 176 and an end cap 178. Cigar case 174 is modified from cigar case 152 by inclusion of a central strip 180 centrally positioned in both the body 176 and end cap 178. Central strip 180 can be a reflective material such as a metal or a polymeric material having a chrome or chrome-like finish. Central strip 180 replaces the leather-covered, third raised portion 170 of cigar case 152. A vial portion 182 includes a vial viewing window 184 which is similar to vial viewing window 172. An engraved leather cover 185 can be provided on surfaces of body 176 and end cap 178 which do not include the central strip 180.

Figure 10:
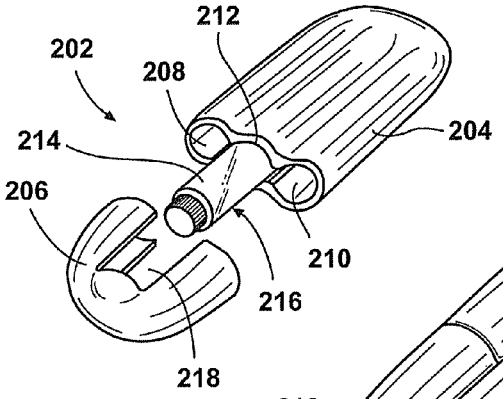
FIG. 10 is a top perspective view of another cigar holder device of the present disclosure in an open configuration.

Referring to FIG. 10, a cigar case 202 includes a body 204 and an end cap 206 which is releasably connectable to body 204. End cap 206 is shown in the open/removed position such that access is provided within body 204 to a first cigar cavity 208 and an oppositely positioned second cigar cavity 210. Each of the first and second cigar cavities 208, 210 is semi-spherically shaped and is therefore capable of slidably receiving individual cigars (not shown). Positioned directly between each of the first and second cigar cavities 208, 210 is a vial receiving cavity 212 which is also semi-spherically shaped. Vial receiving cavity 212 slidably and frictionally receives a vial 214 which can contain a drinkable fluid which is accessible by removing end cap 206. Vial 214 has a transparent or semi-transparent vial body 216 such that a fluid level within vial 214 is visually indicated to the user. An opening 218 is also provided in end cap 206 whose purpose will be further described in reference to FIG. 12.

Figure 11:
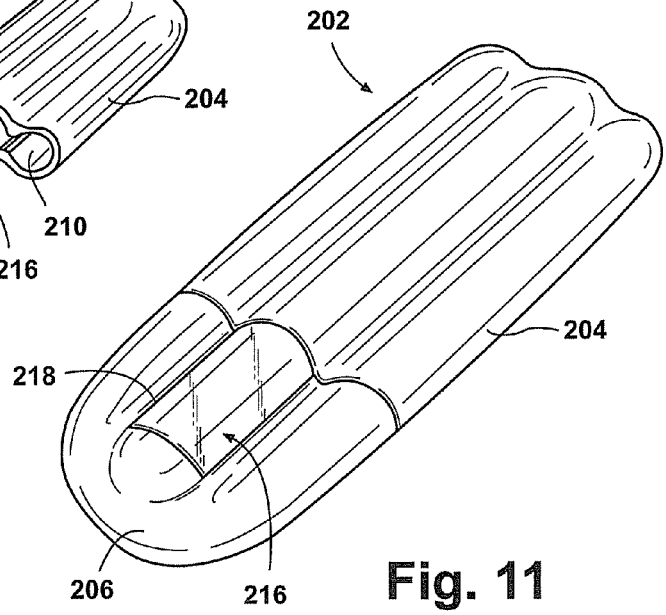
FIG. 11 is a top perspective view of the cigar holder device of FIG. 10 shown in a fully closed configuration.

Referring to FIG. 11, end cap 206 is shown in its closed/connected condition to body 204. In this condition, vial body 216 is partially viewable because it is partially exposed through opening 218. A fluid level within vial 214 is therefore also visible via opening 218 through a portion of vial body 216 which is therefore exposed even with end cap 206 in the installed position. A separate viewing window is therefore not required for cigar case 202.

Figure 12:
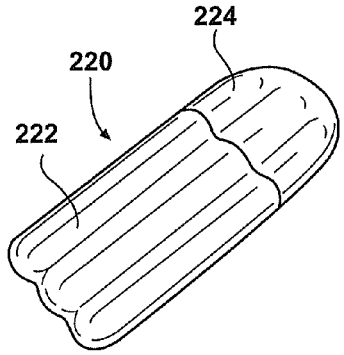
FIG. 12 is a top perspective view of another cigar holder device of the present disclosure in a fully closed configuration.
Figure 13:
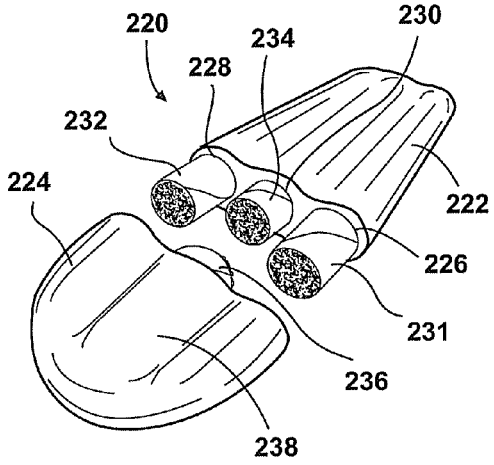
FIG. 13 is the top perspective view of the cigar holder device of FIG. 12 shown in an open configuration.

Referring to FIGS. 12 and 13, a cigar case 220 includes a body 222 having a releasably connectable end cap 224. When end cap 224 is removed from body 222, a first cigar cavity 226 and a second cigar cavity 228 (which each can include a first cigar 231 and a second cigar 232, respectively) are accessible to the user. Each of first and second cigar cavities 226, 228 is substantially circular in cross-sectional shape. Positioned directly between first and second cigar cavities 226, 228 is a third cigar cavity 230, which also has a substantially circular cross-sectional shape. Each of the first or second cigars 231, 232 can be greater in length than a third cigar 234 received in third cigar cavity 230. The reason for this length discrepancy is that the first and second cigars 231, 232 can be partially received in end cap 224. A vial end cap 236 of a vial portion 238 which is provided in end cap 224 prevents the third cigar 234 from extending into end cap 224. Vial end cap 236, similar to other vial end caps previously described herein, is removable to access a fluid provided within the vial portion 238 for drinking by the user. The body 222 and end cap 224 of cigar case 220 can be both entirely made of a metal or a plastic material.

Referring to FIG. 14, a cigar case 240 according to a further embodiment includes a leather or similar texture material clad body 242 which is closed using a folding end cover 244 (shown in its open position). End cover 244 includes a latch 246 that releasably engages a latch receiver 248 provided with body 242 to close end cover 244. An insert 250 which according to several embodiments is made of a wood such as cedar is slidably and frictionally received in body 242. Insert 250 includes several semicircular portions which are pre-formed and arranged substantially parallel to each other. A first semicircular portion 252 is sized to slidably receive a first cigar 254 and a second semicircular portion 256 is sized to slidably receive a second cigar 258. A fluid holding vial 260 is releasably received in a third semicircular portion 261 which can be positioned between first and second semicircular portions 252, 256.

At least one punch portion 262 is movably connected to a body side frame 264 at a connecting joint 266. Punch portion 262 is shown in both an installed and a removed position. A hinge 268 can be connected at the connecting joint 266 and to punch portion 262 to rotatably connect punch portion 262 to body side frame 264. A cigar punch 270 is provided with punch portion 262 which is accessible when punch portion 262 is in an open or removed position. A second punch portion 262' (which does not include punch 270) is positioned on an opposite side of body 242. Also provided with body 242 is a viewing window 272 which can be a semitransparent or transparent plastic or glass material. Similar to other viewing windows previously described herein, viewing window 272 is aligned with and provides visual indication of a quantity or level of a fluid in vial 260 if vial 260 is itself made of a semitransparent or transparent plastic or glass material.

Referring to FIG. 15 and again to FIG. 14, folding end cover 244 is shown in its closed position with respect to body 242. Cover 244 is folded over a semicircular end 274 of punch portions 262 to provide internal clearance with first and second cigars 254, 258. The middle positioning of vial 260 between first and second cigars 254, 258 provides further internal support and clearance between folding end cover 244 and the cigars.

Referring to FIG. 16 and again to FIG. 14, third semicircular portion 261 can be modified to include an oval or elongated side-to-side shape to increase the volume of storage area available for a similarly shaped vial 260 (not shown). Insert 250 is modified as necessary to accommodate the geometry of third semicircular portion 261.

Referring to FIG. 17 and again to FIG. 14, in the closed condition or position of cigar case 240, a trim piece 276 can be provided to hide the latch 246 and latch receiver 248 from view. Stitching lines 278, 278' can be provided to enhance the visual image of a material or covering of body 242. A leather or leather-like appearing material can be used as a cover to provide a frictional surface for body 242 and folding end cover 244.

Referring to FIG. 18 and again to FIG. 14, a vial 280 can be substituted for vial 260. Vial 280 can be made of a metal or plastic material body 282 that does not have transparent or semitransparent qualities, but can be used for its increased rigidity. Vial 280 includes a releasable vial end cap 284 which is sealed using a seal member 286 such as an O-ring at a junction 288 between vial end cap 284 and body 282. Vial body 282 is shown in a tubular form however the shape of vial body 282 can have substantially any geometry at the discretion of the manufacturer.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A portable cigar case, comprising:

a body having a first and a second retention portion each for receiving and releasably retaining a cigar, the first and second retention portions oppositely rotatably extendable from the body and each positioned between a closed and an open position, the open position providing access to the cigar;

a vial containing a drinking fluid retained by a releasable cap; and a viewing window created in the cigar case and aligned with the vial and made of a transparent or semitransparent material such that the fluid in the vial is visible through the viewing window.

2. The portable cigar case of claim 1, further including a hinge individually rotatably connecting each of the first and second retention portions to the body.

3. The portable cigar case of claim 2, further including first and second retention members individually fixedly connected to one of the first or second retention portions and the body operating to retain the first and second retention portions at the open position.

4. The portable cigar case of claim 3, wherein the first and second retention members are made of a flexible material.

5. The portable cigar case of claim 3, wherein the first and second retention members are each made of a substantially rigid material slidably received within the body in the closed position.

6. The portable cigar case of claim 1, further including a moisture retainer provided in the body, the moisture retainer providing a source of moisture independent of the drinking fluid to maintain a humidity level of the cigar in each of the first and second retention portions when the first and second retention portions are in the closed position.

* * * * *